US010301790B2

(12) United States Patent
Strand et al.

(10) Patent No.: US 10,301,790 B2
(45) Date of Patent: May 28, 2019

(54) SYSTEM AND METHOD FOR ESTABLISHING A MULTI-WELL FOUNDATION COMPRISING AN ALIGNMENT TEMPLATE FOR SUCTION FOUNDATION UNITS

(71) Applicant: NeoDrill AS, Ålgård (NO)

(72) Inventors: Harald Strand, Ålgård (NO); Wolfgang Mathis, Sandnes (NO)

(73) Assignee: NeoDrill AS, Ålgård (NO)

( * ) Notice: Subject to any disclaimer, the term of this patent is extended or adjusted under 35 U.S.C. 154(b) by 0 days.

(21) Appl. No.: 15/735,768

(22) PCT Filed: Jun. 8, 2016

(86) PCT No.: PCT/NO2016/050118
§ 371 (c)(1),
(2) Date: Dec. 12, 2017

(87) PCT Pub. No.: WO2016/200271
PCT Pub. Date: Dec. 15, 2016

(65) Prior Publication Data

US 2018/0171574 A1 Jun. 21, 2018

(30) Foreign Application Priority Data

Jun. 12, 2015 (NO) ..... 20150766

(51) Int. Cl.
*E02D 5/32* (2006.01)
*E02D 7/20* (2006.01)
(Continued)

(52) U.S. Cl.
CPC ..... *E02D 13/04* (2013.01); *B63B 21/27* (2013.01); *E02D 5/32* (2013.01); *E02D 7/20* (2013.01);
(Continued)

(58) Field of Classification Search
CPC .. E02D 13/04; E02D 5/32; E02D 7/20; E02D 27/12; E02D 2250/0053; E21B 33/035; E21B 41/08
See application file for complete search history.

(56) References Cited

U.S. PATENT DOCUMENTS 5,526,882 A * 6/1996 Parks ..... E21B 43/017 166/339
8,025,463 B2 * 9/2011 Foo ..... B63B 21/27 405/224
(Continued)

FOREIGN PATENT DOCUMENTS

CN 202176267 3/2012
KR 20130037384 4/2013

OTHER PUBLICATIONS

Norwegian Search Report, Norwegian Patent Application No. 20150766, dated Jan. 8, 2016.
(Continued)

*Primary Examiner* — James G Sayre
(74) *Attorney, Agent, or Firm* — Andrus Intellectual Property Law, LLP

(57) ABSTRACT

A system is for establishing a collection of well foundations, the well foundations being formed of suction-foundation units arranged to be driven down into an unconsolidated mass. An alignment template includes several through cut-outs, each arranged to receive a suction-foundation unit. The alignment template placed over the unconsolidated mass, forms a means of positioning the suction-foundation units before the suction-foundation units are driven down into the unconsolidated mass. A method of establishing a collection of well foundations is described as well.

15 Claims, 4 Drawing Sheets

(51) Int. Cl.

| | |
|---|---|
| ***B63B 21/27*** | (2006.01) |
| ***E02D 13/04*** | (2006.01) |
| ***E02D 27/12*** | (2006.01) |
| ***E21B 41/08*** | (2006.01) |
| ***E21B 33/035*** | (2006.01) |

(52) U.S. Cl.
CPC ..... *E02D 27/12* (2013.01); *E21B 33/035* (2013.01); *E21B 41/08* (2013.01); *E02D 2250/0053* (2013.01)

(56) References Cited

U.S. PATENT DOCUMENTS

| | | | | |
|---|---|---|---|---|
| 2003/0155119 | A1* | 8/2003 | Crain | E21B 43/017 166/245 |
| 2009/0297276 | A1 | 12/2009 | Foo et al. | |
| 2012/0024535 | A1* | 2/2012 | Lieske, II | E21B 43/0122 166/363 |

OTHER PUBLICATIONS

International Search Report, PCT/NO2016/050118, dated Sep. 1, 2016.
Written Opinion and Response, PCT/NO2016/050118, dated Sep. 1, 2016.
Written Opinion and Response, PCT/NO2016/050118, dated Feb. 23, 2017.
International Preliminary Report on Patentability, PCT/NO2016/050118, date of completion Jun. 9, 2017.

* cited by examiner

SYSTEM AND METHOD FOR ESTABLISHING A MULTI-WELL FOUNDATION COMPRISING AN ALIGNMENT TEMPLATE FOR SUCTION FOUNDATION UNITS

CROSS-REFERENCE TO RELATED APPLICATIONS

This application is the U.S. national stage application of International Application PCT/NO2016/050118, filed Jun. 8, 2016, which international application was published on Dec. 15, 2016, as International Publication WO 2016/200271 in the English language. The International Application claims priority of Norwegian Patent Application No. 20150766, filed Jun. 12, 20165. The international application and Norwegian application are both incorporated herein by reference, in entirety.

FIELD

The invention relates to a system and a method for establishing a collection of well foundations, the well foundations being formed of suction-foundation units, which are arranged to be set down into an unconsolidated mass, especially seabed sediments.

BACKGROUND

When establishing a collection of several wells in a location in a field where hydrocarbons are being extracted, it is often important to space the wellheads evenly in a predetermined pattern with a view to, among other things, being able to prefabricate components that form interconnections between the wellheads. When such collections of wells are to be established in subsea fields, a prefabricated frame structure is often used, which is put down on the sea floor to form a model or template for how the different wells are to be established relative to each other. In addition, the frame structure functions as a foundation for the wellheads and associated elements. Such a frame structure may weigh several hundred tonnes, and it is complicated and expensive both to transport it to the field and to place it on the sea floor. Because of the great weight, there is also a limit to how many wellheads such a frame structure may comprise.

SUMMARY

The invention has for its object to remedy or reduce at least one of the drawbacks of the prior art or at least provide a useful alternative to the prior art.

The object is achieved through the features that are specified in the description below and in the claims that follow.

The invention provides a system and a method for establishing a foundation for a collection of several wells, each well foundation consisting of a suction-foundation unit, and the relative positions of the suction-foundation units, that is to say the horizontal spacing of the suction-foundation units, their difference in height, center-axis direction and so on, are controlled by means of an alignment template which is positioned temporarily or permanently on a sea floor. The alignment template is provided with several cut-outs extending through it, each being arranged to receive and align a suction-foundation unit. The suction-foundation units, which are handled separately, are put into respective cut-outs in the alignment template and pushed down into the sediments below the sea floor in a manner known per se, by the suction-foundation unit being evacuated so that negative pressure develops inside the suction-foundation unit.

The suction-foundation unit and the alignment template may be provided with engagement means for aligning the suction-foundation units around their center axes, for example by the jackets of the suction-foundation units being provided with one or more ribs that engage with corresponding grooves in the cut-outs in the alignment template.

The cut-outs of the alignment template may be encircled by guiding means facilitating the insertion of the suction-foundation unit into the cut-out, for example by each cut-out being encircled by an upstanding funnel or several elements with slanted guide faces.

The alignment template may be provided with laterally stabilizing means, which, by penetration into the sea floor, prevents unintended displacement of the alignment template during the installation of the suction-foundation units. The laterally stabilizing means may be formed as skirts extending downwards from the bottom side of the alignment template.

The alignment template may be provided with system components arranged for use during the installation of the foundations or for use in the subsequent establishing or operation of the well. Typically, such components may consist of pumps, manifolds, pipelines, cables and so on.

The alignment template may be provided with coupling means arranged to fix the alignment template temporarily or permanently to the suction-foundation units.

The alignment template is typically provided with 2×2 or 1×3 cut-outs. When more suction-foundation units than the number contained in the alignment template are being installed, the alignment template may be moved in steps for the installation of further suction-foundation units, the new position of the alignment template being controlled by it being brought into engagement with one or more of the previously installed suction-foundation units. It is an advantage if, in its new position, the alignment template is in engagement with at least two installed suction-foundation units.

The invention is defined by the independent claims. The dependent claims define advantageous embodiments of the invention.

In a first aspect, the invention relates more specifically to a system for establishing a collection of well foundations, the well foundations being formed of suction-foundation units that are arranged to be driven down into a sea floor, characterized by an alignment template including several through cut-outs, each arranged to receive a suction-foundation unit, being positioned over the sea floor and forming a means of positioning the suction-foundation units before the suction-foundation units are forced down into the sea floor, the alignment template and the suction-foundation unit being provided with complementary engagement means for the horizontal directional orientation of the suction-foundation unit relative to the alignment template.

The cut-outs of the alignment template may be encircled by means with sloping surfaces arranged to center the suction-foundation unit in the respective cut-out. The suction-foundation unit is thereby guided into the cut-out even if it is not positioned exactly, in the horizontal plane, when being lowered towards the alignment template.

The alignment template and/or the suction-foundation unit may be provided with coupling means arranged to fix the suction-foundation unit relative to the alignment template. Especially when the alignment template is going to constitute a permanent part of the well assembly, this may be an advantage.

The alignment template may include laterally stabilizing means, which are arranged to penetrate into the sea floor. An advantage of this is that the alignment template cannot unintendedly be pushed out of position, for example by impact from the suction-foundation unit during the placement thereof.

The alignment template may be provided with system components arranged for monitoring and controlling the establishing of the well foundations and/or the operation of the well. It may be an advantage if such equipment can be assembled and tested while still on the surface.

The alignment template may be provided with at least three cut-outs. An advantage of this is that the alignment template may be held fixed by means of two installed suction-foundation units while the third suction-foundation unit is installed, which may improve the precision in the placement of the suction-foundation units.

The alignment template may be provided with one or more protection elements projecting up between the cut-outs to shield a first wellhead against damage during the installation of a second suction-foundation unit and a second wellhead. The advantage of this is that a collection of producing wells may be supplemented with more wells without the risk of the producing wells being damaged.

In a second aspect, the invention relates more specifically to a method of establishing a collection of well foundations by the use of a system according to the first aspect of the invention, characterized by the method comprising the following steps:

a) placing an alignment template on a sea floor;
b) lowering a suction-foundation unit into a cut-out in the alignment template;
c) orienting the suction-foundation unit in the horizontal direction relative to the alignment template by means of complementary engagement means provided in the alignment template and the suction-foundation unit;
d) driving the suction-foundation unit down into the sea floor to a prescribed depth; and
e) repeating steps b) and c).

The method may include the further steps:

f) expanding the collection of well foundations by
f1) moving the alignment template to a position in which at least one suction-foundation unit that has been driven down into the sea floor projects up from one of the cut-outs of the alignment template, and
f2) repeating steps b) and c); and possibly
g) repeating steps f1) and f2).

An advantage of this is that the well assembly may include a large amount of well foundations without the size of the single elements used during the establishing having to be increased.

BRIEF DESCRIPTION OF THE DRAWINGS

In what follows, examples of preferred embodiments are described, which are visualized in the accompanying drawings, in which.

DETAILED DESCRIPTION OF THE DRAWINGS

Figure 1:
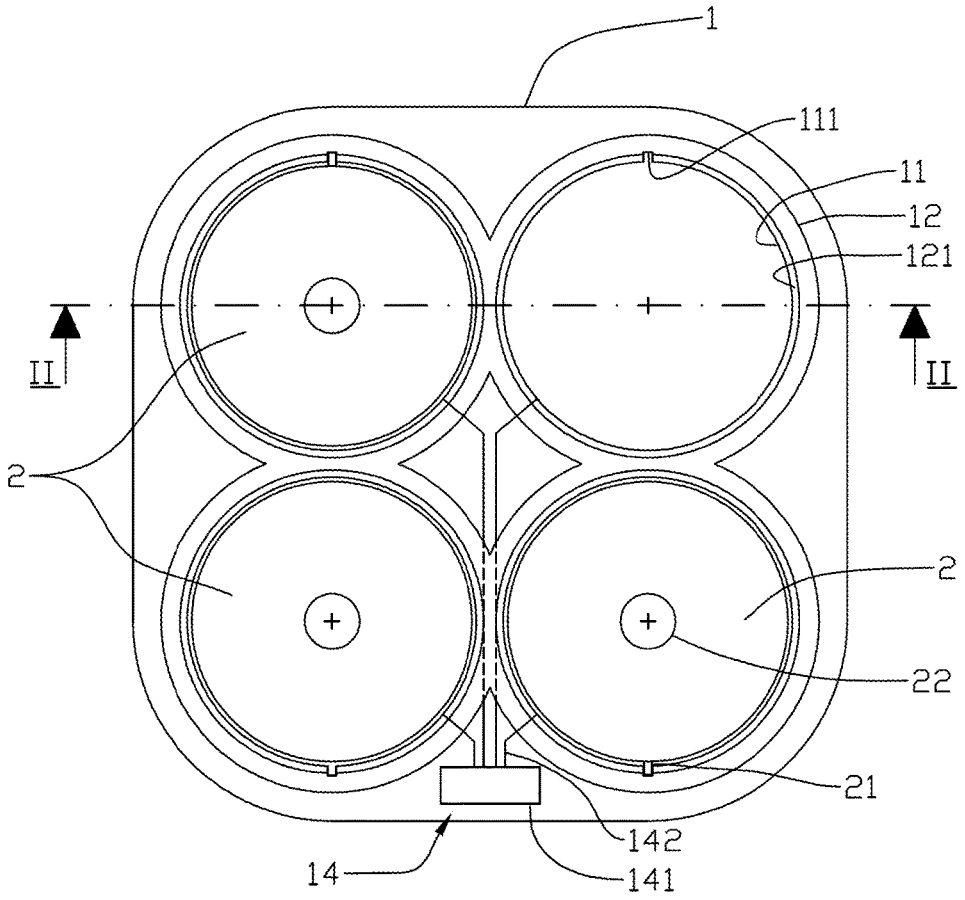
FIG. 1 shows a ground plan of an alignment template and three installed suction-foundation units.

In the figures, the reference numeral 1 indicates an alignment template for positioning suction-foundation units 2 by driving them into an unconsolidated mass 31 over a structure not shown, where, through a supporting pipe 22 in the suction-foundation unit 2, a well not shown is to be established for the potential extraction of a fluid, typically hydrocarbons. The unconsolidated mass 31 is especially subsea sediments and is bounded by a sea floor 3.

The alignment template 1 includes several evenly spaced cut-outs 11. The FIGS. 1 and 3*a-d* show an alignment template 1 having two rows with two cut-outs 11 each, whereas FIGS. 4*a*-4*d* show an alignment template 1 having one row with three cut-outs 11.

Each cut-out 11 is provided with an engagement means for the horizontal directional orientation of the respective suction-foundation unit 2, shown in FIG. 1 as a groove 111 arranged to form a guide for a rib 21 arranged in the axial direction on the jacket surface of the suction-foundation unit 2.

The cut-outs 11 are encircled by a guiding means formed as a ring 12 projecting up from the alignment template 1 and being provided with a slanted guide face 121 arranged to center the suction-foundation unit 2 when this is lowered towards the cut-out 11.

Figure 2:
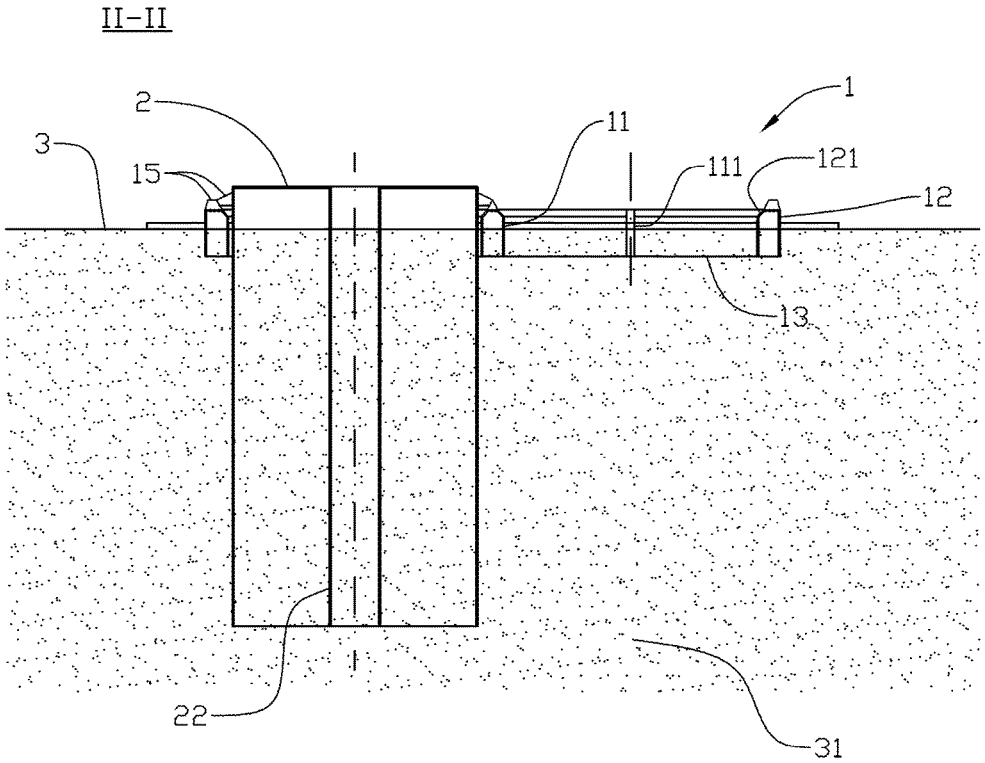
FIG. 2 shows a vertical section through the alignment template and one suction-foundation unit.
Figure 3A:
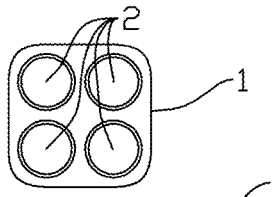
FIGS. 3*a-d* show ground plans on a smaller scale of a stepped installation of a collection of 2×4 wells.
Figure 3B:
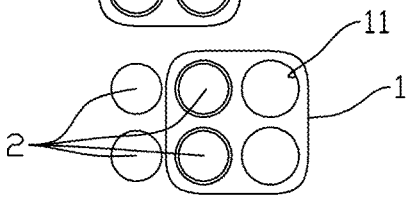
Figure 3C:
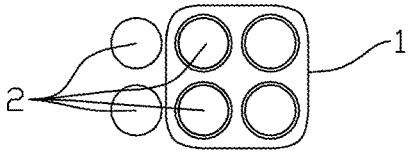
Figure 3D:
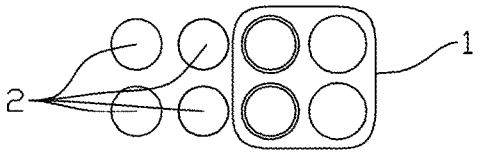
Figure 4A:
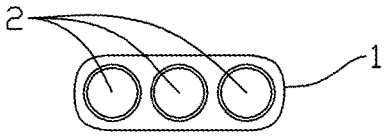
FIGS. 4*a-d* show ground plans of a collection of 1×7 wells.
Figure 4B:
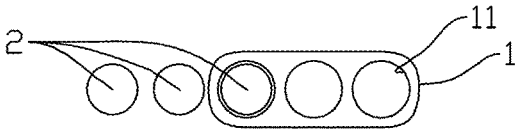
Figure 4C:
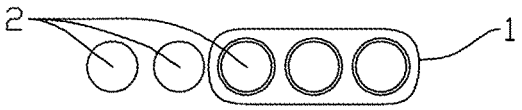
Figure 4D:
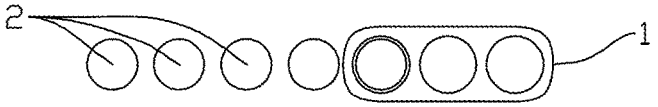

The alignment template 1 is further provided with several laterally stabilizing means, shown in FIG. 2 as skirts 13 encircling the cut-outs 11 and projecting downwards from the bottom side of the alignment template 1, arranged to penetrate into the unconsolidated mass 31 when the alignment template 1 is being placed on the sea floor 3.

The alignment template 1 and the suction-foundation units 2 are provided with coupling means 15 (see FIG. 2) for fixing the alignment template 1 to the suction-foundation units 2 after the suction-foundation units 2 have been placed in the prescribed positions. This is particularly relevant if the alignment template 1 is to form a permanent part of the well assembly and is to carry system components 14, shown schematically in FIG. 1 as a pump unit 141 with associated wiring 142 arranged for monitoring and controlling the establishing of the well foundations and/or the operation of the well.

FIGS. 3*a-d* and 4*a-d* show how two rows and one row, respectively, of well foundations can be established with even spacing of the suction-foundation units 2 by moving the alignment template 1 in steps as completely installed suction-foundation units 2 are used as means of providing at least even spacing of the suction-foundation units 2 of a row. When the alignment template 1 is positioned by means of two completely installed suction-foundation units 2, as is shown in FIGS. 3*a-d*, the well-foundation rows will be arranged in line, whereas the positioning of the alignment template 1 by means of just one suction-foundation unit 2, as appears from FIGS. 4*a-d*, requires alignment of the alignment template 1 with the help of other means, for example the lifting equipment (not shown) which is used when the well foundations are being established.

By providing the alignment template 1 with at least three cut-outs 11, the direction of the alignment template 1 can always be controlled during the stepped movement, by the alignment template 1 being in engagement with two completely installed suction-foundation units 2.

A significant advantage of the system and method according to the invention is that the establishing of the well foundation may be carried out by using lifting equipment of moderate capacity as, independently of the total number of wells in the collection, none of the modules in the collection of well foundations will ever include more than one suction-foundation unit 2 or one alignment template 1.

The alignment template 1 may be designed in such a way that it gives little risk of damaging equipment involved if fishing equipment, for example a trawl, comes into contact with the well foundation. The alignment template may in itself be formed with slanted and/or rounded side faces or be provided with attachments for trawl caps of a kind known per se.

Figure 5A:
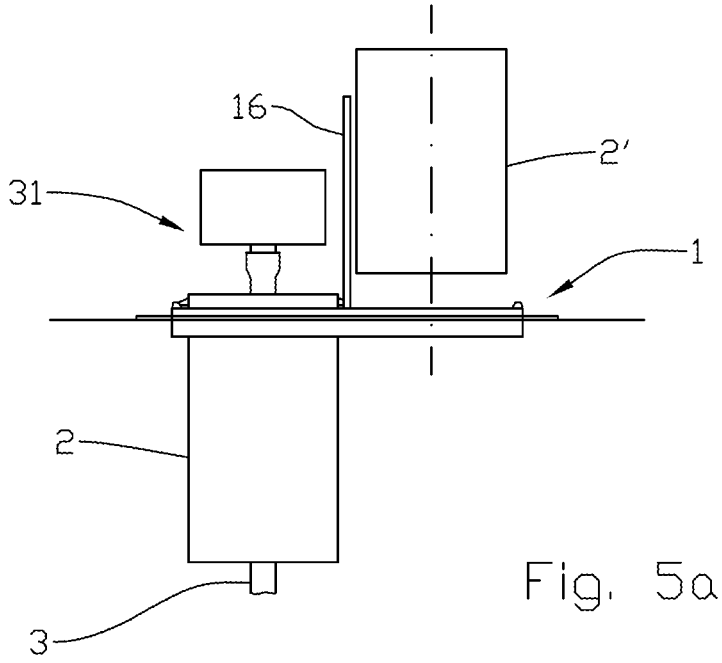
FIGS. 5*a-b* show side views on a larger scale of the alignment template provided with protection means for an installed wellhead during the establishing of a new well.
Figure 5B:
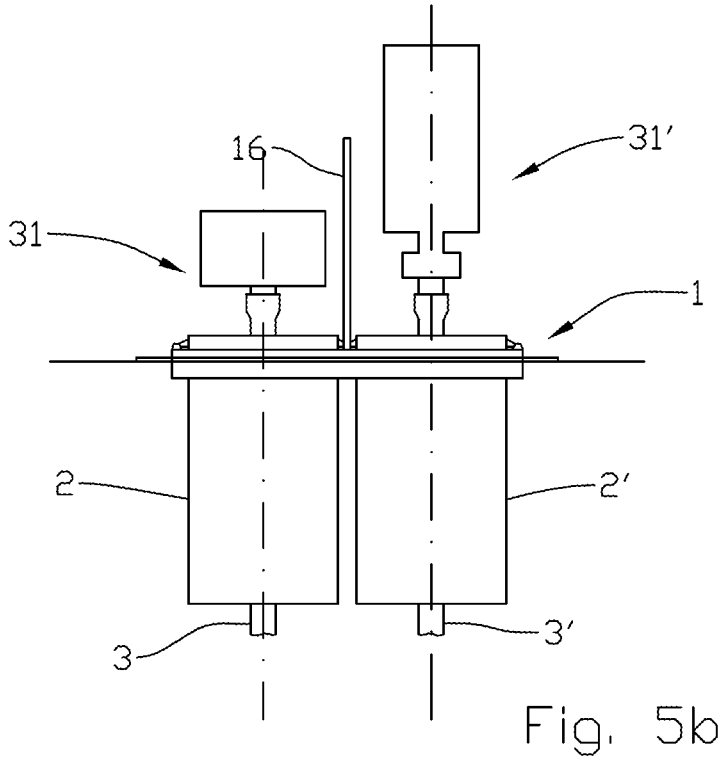

Reference is now made to FIGS. 5*a* and 5*b* in which, in the alignment template 1, a first well 3 has been established, including a first wellhead 31 based on a first suction-foundation unit 2. To protect the first wellhead 31 during the subsequent establishing of a second well 3', the alignment template 1 is provided with a protection element 16, shown schematically here as a wall 16 projecting up between the first and second suction-foundation units 2, 2' and shielding the first wellhead 31 during the installation of the second suction-foundation unit 2' and subsequent mounting of the various elements of the second well, for example the second wellhead 31'. The protection element 16 may be installed temporarily or permanently, and, especially by permanent installation, the protection element 16 may be used as a base for various equipment connected to one or more wells 3, 3'.

The use of the verb "to comprise" and its different forms does not exclude the presence of elements or steps that are not mentioned in the claims. The indefinite article "a" or "an" before an element does not exclude the presence of several such elements.

The fact that some features are indicated in mutually different dependent claims does not indicate that a combination of these features cannot be used with advantage.

The invention claimed is:

1. A system for establishing a collection of two or more well foundations, the two or more well foundations being formed of suction-foundation units arranged to be forced down into a sea floor, the system comprising an alignment template which includes several through cut-outs, each configured to receive a suction-foundation unit, wherein the alignment template is configured such that when the alignment template is placed on the sea floor, the alignment template positions each of the suction-foundation units before each of the suction-foundation units is driven down into the sea floor, wherein the alignment template and the suction-foundation unit comprise complementary engagement features that provide horizontal directional orientation of the suction-foundation unit relative to the alignment template, and wherein the alignment template is configured to be withdrawn from the sea floor while each of the suction-foundation units remains driven down into the sea floor.

2. The system according to claim 1, wherein the cut-outs of the alignment template are encircled by sloping faces configured to center the suction-foundation unit in the respective cut-out.

3. The system according to claim 1, further comprising a coupling system configured to fix the suction-foundation unit relative to the alignment template.

4. The system according to claim 3, wherein the coupling system includes a groove defined in the alignment template that is configured to receive a rib on one of the suction-foundation units.

5. The system according to claim 1, wherein the alignment template comprises lateral stabilizers that are configured to penetrate into the sea floor.

6. The system according to claim 1, wherein the alignment template comprises system components configured to monitor and control at least one of the establishing of the well foundations and the operation of the well.

7. The system according to claim 1, wherein the alignment template comprises at least three cut-outs.

8. The system according to claim 1, wherein the alignment template is provided with one or more protection elements projecting up between the cut-outs to shield a first wellhead from damage during the installation of a second suction-foundation unit and a second wellhead.

9. The system according to claim 1, wherein the cut-outs in the alignment template are provided as a 2×2 configuration.

10. A method of establishing a collection of well foundations being formed of suction-foundation units arranged to be forced down into a sea floor, the method using a system comprising an alignment template which includes several through cut-outs, each configured to receive a suction-foundation unit, wherein the alignment template is configured such that when the alignment template is placed on the sea floor, the alignment template positions each of the suction-foundation units before each of the suction-foundation units is driven down into the sea floor, wherein the alignment template and the suction-foundation unit comprise complementary engagement features that provide horizontal directional orientation of the suction-foundation unit relative to the alignment template, the method comprising:

a) placing the alignment template on the sea floor;

b) lowering the suction-foundation unit into one of the cut-outs in the alignment template;

c) orienting the suction-foundation unit in the horizontal direction relative to the alignment template via the complementary engagement features provided in the alignment template and the suction-foundation unit;

d) forcing the suction-foundation unit down into the sea floor to a prescribed depth; and e) repeating steps b) and c).

11. The method according to claim 10, wherein the method comprises:

f) expanding the collection of well foundations by f1) moving the alignment template to a position in which at least one suction-foundation unit which has been forced down into the sea floor projects up from one of the cut-outs of the alignment template, and f2) repeating b) and c).

12. The method according to claim 11, wherein the method comprises repeating steps f1) and f2).

13. A system for establishing a collection of well foundations, the well foundations being formed of suction-foundation units arranged to be forced down into a sea floor, the system comprising an alignment template which includes several through cut-outs, each configured to receive a suction-foundation unit, wherein the alignment template is configured such that when the alignment template is placed on the sea floor, the alignment template positions the suction-foundation units before the suction-foundation units are driven down into the sea floor, wherein the alignment template and the suction-foundation unit comprise complementary engagement features that provide horizontal directional orientation of the suction-foundation unit relative to the alignment template, wherein the alignment template is provided with one or more protection elements projecting up between the cut-outs to shield a first wellhead from damage during the installation of a second suction-foundation unit and a second wellhead.

14. A method of establishing a collection of well foundations being formed of suction-foundation units arranged to be forced down into a sea floor, the method using a system comprising an alignment template which includes several through cut-outs, each configured to receive a suction-foundation unit, wherein the alignment template is configured such that when the alignment template is placed on the sea floor, the alignment template positions the suction-foundation units before the suction-foundation units are driven down into the sea floor, wherein the alignment template and the suction-foundation unit comprise complementary engagement features that provide horizontal directional orientation of the suction-foundation unit relative to the alignment template; the method comprising:

a) placing the alignment template on the sea floor;

b) lowering the suction-foundation unit into one of the cut-outs in the alignment template;

c) orienting the suction-foundation unit in the horizontal direction relative to the alignment template via the complementary engagement features provided in the alignment template and the suction-foundation unit;

d) forcing the suction-foundation unit down into the sea floor to a prescribed depth;

e) repeating steps b) and c);

f) expanding the collection of well foundations by f1) moving the alignment template to a position in which at least one suction-foundation unit which has been forced down into the sea floor projects up from one of the cut-outs of the alignment template, and f2) repeating b) and c).

15. The method according to claim 14, wherein the method comprises repeating steps f1) and f2).

* * * * *